US008231201B2

(12) United States Patent
Ito

(10) Patent No.: US 8,231,201 B2
(45) Date of Patent: Jul. 31, 2012

(54) INKJET RECORDING DEVICE

(75) Inventor: Shigeyuki Ito, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 802 days.

(21) Appl. No.: 12/026,655

(22) Filed: Feb. 6, 2008

(65) Prior Publication Data

US 2008/0218553 A1 Sep. 11, 2008

(30) Foreign Application Priority Data

Mar. 9, 2007 (JP) ..... 2007-059388

(51) Int. Cl.
*B41J 2/165* (2006.01)

(52) U.S. Cl. ..... 347/33; 347/23

(58) Field of Classification Search ..... 347/33, 347/23

See application file for complete search history.

(56) References Cited

U.S. PATENT DOCUMENTS

| | | | | |
|---|---|---|---|---|
| 4,959,673 | A * | 9/1990 | Noda | 347/33 |
| 5,539,435 | A * | 7/1996 | Uchida et al. | 347/33 |
| 6,151,044 | A * | 11/2000 | Gaasch | 347/33 |
| 2002/0109744 | A1* | 8/2002 | Shindo | 347/23 |
| 2004/0061736 | A1* | 4/2004 | Yun et al. | 347/33 |
| 2004/0212657 | A1* | 10/2004 | Tee et al. | 347/33 |
| 2005/0146554 | A1 | 7/2005 | Asanuma et al. | |
| 2005/0194730 | A1 | 9/2005 | Nishida et al. | |

FOREIGN PATENT DOCUMENTS

| | | |
|---|---|---|
| JP | 7-32611 | 2/1995 |
| JP | 9-314852 | 12/1997 |
| JP | 2000-246908 | 9/2000 |
| JP | 3234087 | 9/2001 |
| JP | 2002-79680 | 3/2002 |
| JP | 2003-1833 | 1/2003 |
| JP | 2004-188369 | 7/2004 |
| JP | 2006-192693 | 7/2006 |

OTHER PUBLICATIONS

Sep. 30, 2011 Japanese official action in connection with a counterpart Japanese patent application.

* cited by examiner

*Primary Examiner* — Charlie Peng
*Assistant Examiner* — Peter Radkowski
(74) *Attorney, Agent, or Firm* — Cooper & Dunham LLP

(57) ABSTRACT

In an inkjet recording device, ink droplets remaining on a nozzle surface are wiped off and the wiped off ink droplets are prevented from being scattered so as to stably form good quality images. When the wiper blade wiping the nozzle surface of the recording heads to wipe off the ink droplets and the like is separated from the nozzle surface and the bend of the wiper blade is straightened to restore to its idle position, a reaction force eliminating member absorbs the reaction force generated and softly restores the wiper blade to its idle position. As a result, the reaction force caused when the bend of the wiper blade is suddenly straightened is controlled, thereby preventing the ink drops and foreign matter on the header of the wiper blade from being scattered and avoiding the contamination of the inside of the inkjet recording device.

14 Claims, 9 Drawing Sheets

14
141
43
48
44
45

INKJET RECORDING DEVICE

BACKGROUND

1. Technical Field

This disclosure relates to an inkjet recording device for printing images on a printing medium by ejecting ink, and more particularly to a wiping device for eliminating fluid attached to the nozzle of the inkjet printer.

2. Description of the Related Art

An inkjet recording device is generally required to have a mechanism for maintaining the performance of the recording head that ejects ink droplets. As the functions of the mechanism, there are, for example, a capping function to prevent the nozzles ejecting ink droplets from dehydrating, a pumping function to fill the recording head with ink, and a nozzle cleaning function to clean the surface of the nozzle array of the recording head. Among those functions, the nozzle cleaning function is important, because when ejected ink droplets remain on the nozzle surface or foreign matter adheres to the nozzle surface, ink droplets may be ejected in the undesired direction or may become unable to be ejected, thereby seriously degrading the printing quality and image forming performance.

Furthermore, the speed of image forming processing has been increased in recent inkjet recording devices. To that end, throughputs improved by increasing the number of nozzles of the recording head so that more ink droplets can be ejected in a single scan. As a result, more ink droplets may be left behind on the nozzle surface and the remaining ink droplets are wiped off with a wiper blade. However, when the nozzle surface is wiped off by the wiper blade as described, there is a problem that the ink droplets wiped off from the nozzle surface and adhered to the wiper blade may be flicked off at the moment when the wiper blade is separated from the recording head after wiping the nozzle surface due to the elastic reaction of the wiper blade, thereby contaminating the inside of the printer body with the spattered ink droplets and degrading the printing quality.

To prevent the ink droplets adhered to the wiper blade from flicking off from the wiper blade, according to an inkjet recording device disclosed in the Patent Document 1 below, the wiper blade separates from the nozzle surface after passing the middle of the nozzle surface but before passing the end of the nozzle surface so that the wiper blade and the recording head are no longer in contact after the elastically deformed condition of the wiper blade is released.

Further, according to an inkjet recording device disclosed in the Patent Document 2 below, when the ink droplets left behind on the nozzle surface of the recording head are wiped with a wiper blade capable of moving in the direction vertical to the height direction of the nozzle surface of the recording head, a carriage on which the recording head is mounted while performing a round-trip scanning movement is stopped in the middle of wiping operations while the wiper blade is bent. Then the wiper blade is moved to wipe the remaining nozzle surface while the wiper blade is gradually being lowered so as to reduce the elastic deformation of the wiper bade, thereby reducing the amount of flicked ink droplets.

According to an inkjet recording device disclosed in the Patent Document 3 below, the wiper member for wiping off the nozzle surface of a recording head includes an ink absorbing section having elastic and superior water-absorbing characteristics and a wiping section provided adjacent to the ink absorbing section, closer to the nozzle surface than the ink absorbing section, and having lower water-absorbing characteristics. As a result, the wiping section wipes the ink droplets and the paper dust on the nozzle surface and then the wiped ink droplets and the like are absorbed into the ink absorbing section, thereby preventing the ink droplets from scattering.

Further, according to an inkjet recording device disclosed in the Patent Document 4 below, there is provided an escape surface on the downstream side of the recording head (on the side where the wiper blade separates from the recording head) such that the height direction of the recording head vertical to the nozzle surface is gradually reduced as the wiper blade approaches the end of the downstream side of the recording head. Because of this structure, when the wiper blade wiping the nozzle surface proceeds to wipe the escape surface, the elastic deformation of the wiper blade is gradually reduced, thereby preventing the remaining ink droplets on the header of the wiper blade from flicking off caused by the reaction force due to suddenly eliminating the elastic deformation of the wiper blade.

Patent Document 1: Japanese Patent Publication No: 3234087

Patent Document 2: Japanese Patent Application Publication No: 2006-192693

Patent Document 3: Japanese Patent Application Publication No: 2003-1833

Patent Document 4: Japanese Patent Application Publication No: 2002-79680

However, when the wiper blade separates from the nozzle surface after passing the middle of the nozzle surface but before passing the end of the nozzle surface as described in the Patent Document 1, or when the wiper blade gradually recedes from the nozzle surface during the wiping operations as described in the Patent Document 2, the portion between the middle to the end of the nozzle surface cannot be sufficiently wiped due to insufficient contacting pressure exerted by the wiper blade. As a result, the nozzle surface cannot be cleaned sufficiently and, disadvantageously, the ink droplets remaining on the nozzle surface due to the insufficient cleaning may contaminate recording paper.

Further, even when the wiper blade is arranged so that the wiping section having lower water-absorbing characteristics wipes the ink droplets and the paper dust on the nozzle surface, and then the wiped ink droplets and the like are absorbed into the ink absorbing section having superior water-absorbing characteristics as described in the Patent Document 3, the ink droplets may not be sufficiently absorbed into the ink absorbing section in a case where the paper dust adheres to the surface of the ink absorbing section.

Still further, the ink absorbing section is usually formed of an interconnected porous material so as to have water-absorbing characteristics. Since the holes of the porous material are likely to be sealed with a material such as the pigment of ink, the ink absorbing section may not stably absorb ink droplets for the long term. As a result, unfortunately, the scattering of ink droplets cannot be sufficiently prevented.

Further, since the wiper member includes an ink absorbing section having elastic and superior water-absorbing characteristics and a wiping section having lower water-absorbing characteristics, the structure of the wiper member is complicated, thereby complicating the forming process and increasing the cost of the wiper member.

Further, since the escape surface is formed on the downstream side of the nozzle surface to be wiped with the wiper blade as described in the Patent Document 4, the wiper blade cannot contact the escape surface with sufficient contact pressure. As a result, more ink droplets are likely to be left behind on the escape surface. In addition, if the left ink droplets are accumulated on the escape surface, the accumulated ink droplets may contaminate recording paper.

BRIEF SUMMARY OF THE INVENTION

In an aspect of this disclosure, there is provided an inkjet recording device capable of wiping the nozzle surface to the end of the nozzle surface with sufficient contact pressure so as to wipe off the remaining ink droplets on the nozzle surface, thereby preventing the wiped ink droplets from scattering to stably form good quality images.

According to another aspect, there is provide an inkjet recording device including a recording head ejecting ink droplets to record a character and an image onto a recording medium, a carriage with the recording head mounted thereon performing a round-trip scanning movement, a wiping unit, and a blade elevating unit disposed within a scanning range of the carriage and moving the wiping unit upward and downward in the height direction of the nozzle surface of the recording head. The wiping unit includes a wiper blade made of an elastic body and formed in a flat plate shape for wiping a nozzle surface of the recording head, and a reaction force eliminating member reducing a reaction force of the wiper blade generated when a wiping operations of the wiper blade is terminated.

According to another aspect, the reaction force eliminating member has a spring characteristic, is made of a material having a Young's modulus higher than that of the wiper blade, and has a flat plate shape.

According to still another aspect, a supporting unit supports the wiper blade and the reaction force eliminating member has convex parts provided one on each upper end part thereof, the convex parts face the wiper blade, and the wiper blade and the reaction force eliminating member stand substantially upright on the supporting unit.

According to still another aspect, the supporting unit is removably attached to the blade elevating unit.

According to another aspect, the header of the wiper blade wipes the nozzle surface of the recording head to wipe off the ink droplets and the like on the nozzle surface. When the header of the nozzle surface separates from the nozzle surface, the reacting force eliminating member absorbs the reaction force of the wiper blade so that the bent wiper blade is restored to its upright original position. As a result, the reaction force that would be otherwise generated by suddenly restoring the bent blade can be controlled, the scattering of the ink droplets and the foreign matter on the header of the wiper blade can be effectively prevented, and the contamination inside the inkjet recording device can be avoided accordingly.

Further, the reaction force generated when the bent wiper blade is restored can be stably absorbed when the reaction force elimination member is formed so as to have a spring characteristic, made of a material having a Young's modulus higher than that of the wiper blade, and has a flat plate shape.

Further, convex parts are provided one each on surfaces of the upper portion of the reaction force eliminating member such that the convex parts face the wiper blade. Then the supporting unit supports the reaction force eliminating member and the wiper blade so that the reaction force eliminating member and the wiper blade stand upright to secure the position accuracy of the wiper blade and the reaction force eliminating member, thereby enabling the secure absorption of the reaction force when the bent wiper blade is restored.

Further, the wiper blade can be easily replaced when the supporting unit is provided so as to be attached to and detached from the blade elevating unit.

DETAILED DESCRIPTION OF THE PREFERRED EMBODIMENTS

Figure 1:
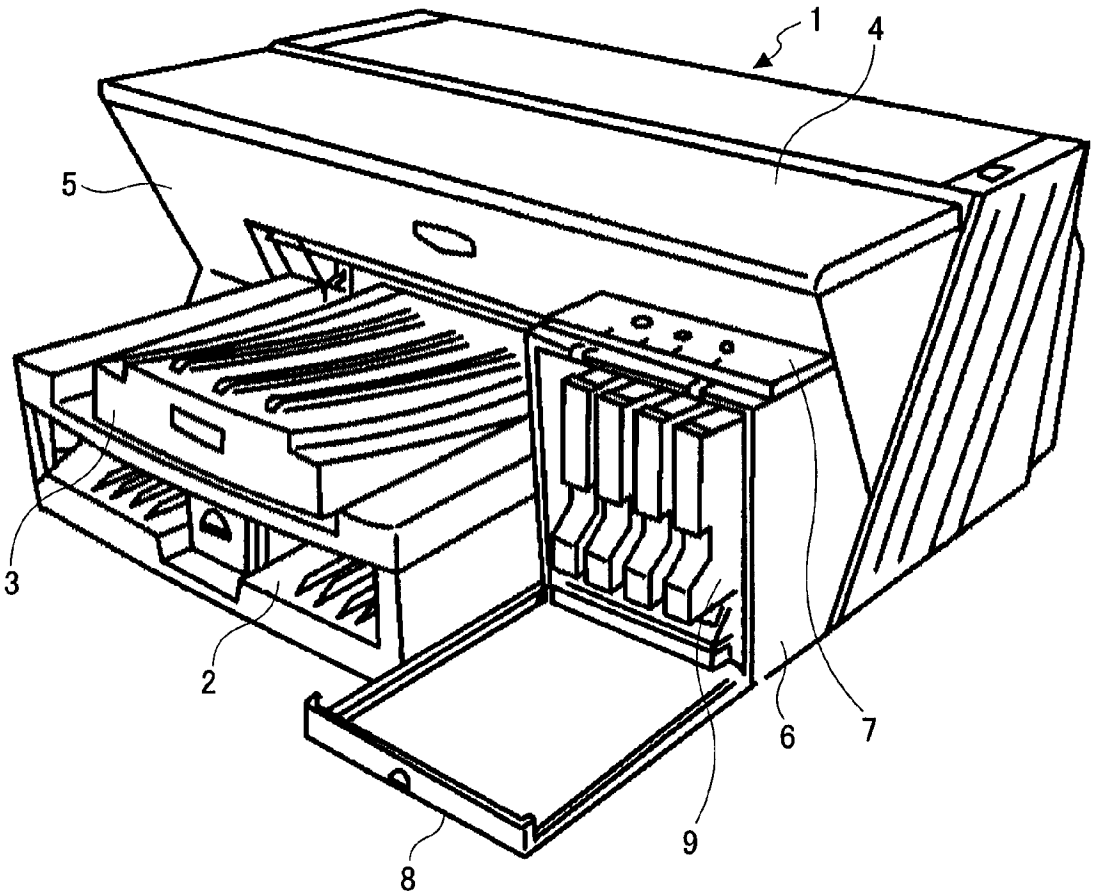
FIG. 1 is a perspective view of an inkjet recording device according to an embodiment of the present invention when viewed from a front side.

FIG. 1 is a perspective view of an inkjet recording device according to an embodiment of the present invention when viewed from a front side. The inkjet recording device includes a device main body 1, a paper feeding tray 2 attached to the device main body 1 and storing recording papers, a paper discharging tray 3 attached to the device main body 1 and storing the recording papers on which images are recorded. An upper cover 4 is provided above the device main body 1 so as to be opened and closed. There is a cartridge mounting section 6 projected through a part of a front surface 5 of the device main body 1 and lower than the upper cover 4. There is an operating section 7 above the cartridge mounting section 6, including operation keys and a display. The cartridge mounting section 6 includes a front cover 8 to be opened and closed, and while the front cover 8 is opened, ink cartridges 9 which are main tanks for supplying inks can be detached and attached.

Figure 2:
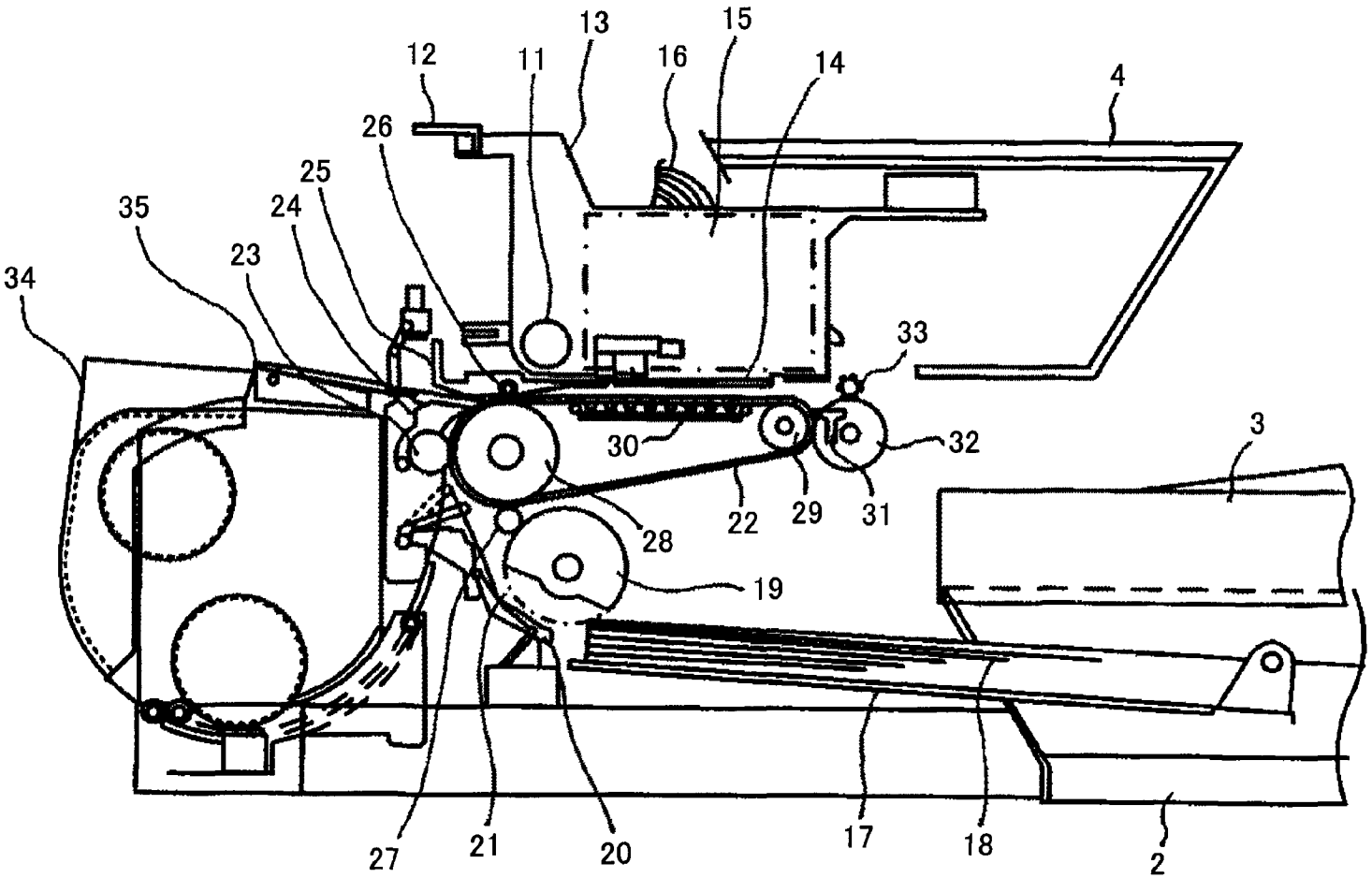
FIG. 2 is a cut-open side view showing the configuration of a mechanical part of the inkjet recording device.
Figure 3:
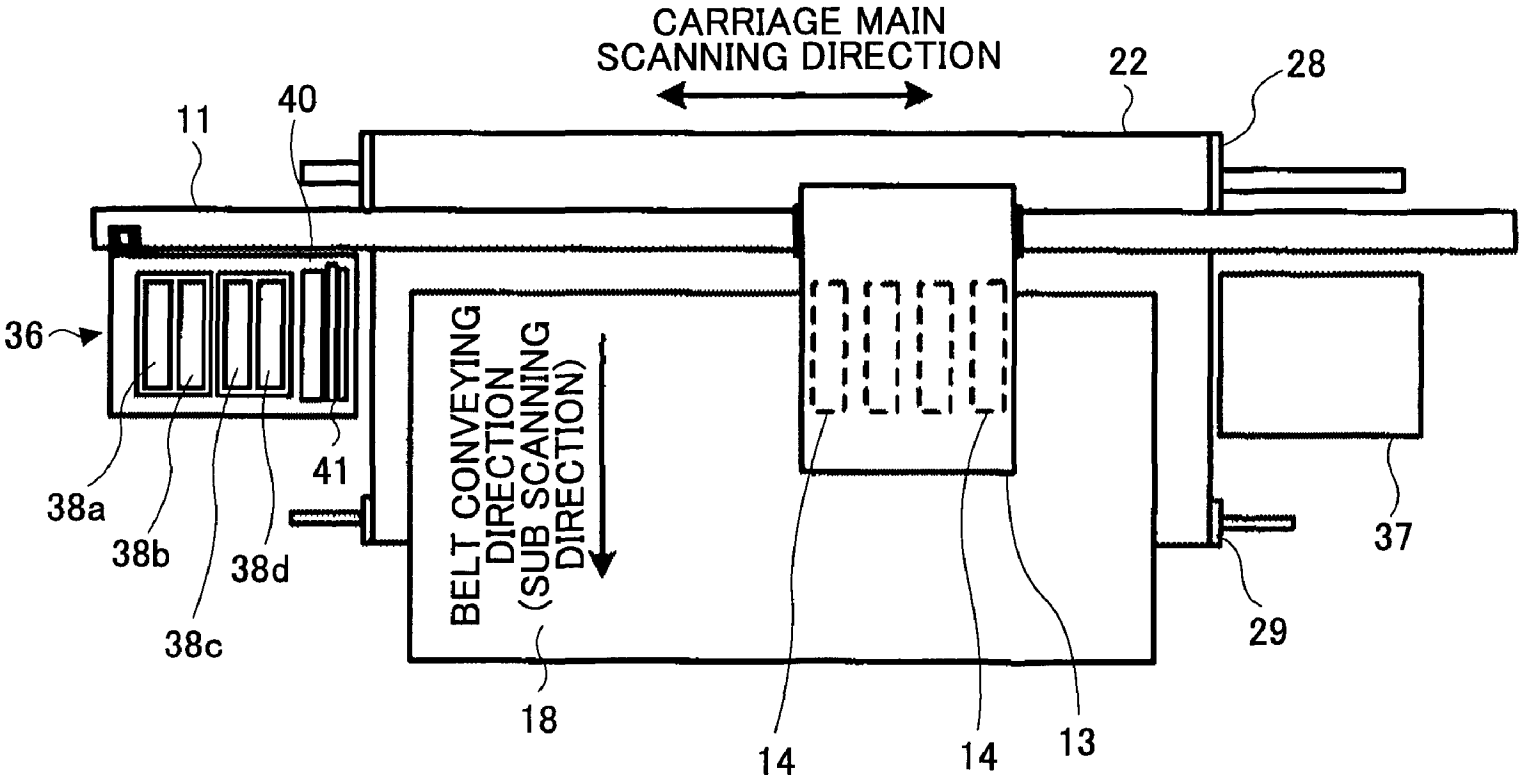
FIG. 3 is a top view showing the configuration of a mechanical part of the inkjet recording device.

FIGS. 2 and 3 show a mechanical part of the inkjet recording device. The mechanical part includes a guide rod 11, a stay 12, a carriage 13, and recording heads 14. The guide rod 11 and the stay 12 are guiding members placed laterally between the side plates of the device main body 1. Further, the guide rod 11 and the stay 12 hold the carriage 13 so that the carriage 13 can slide in a main scanning direction. The carriage 13 is moved in the main scanning direction by a main scanning motor (not shown). In the carriage 13, there are attached recording heads 14 including the inkjet heads that eject the ink droplets of the corresponding colors of yellow (Y), cyan (C), magenta (M), and black (B). The plural ink ejecting openings of the inkjet heads are arranged in the direction vertical to the main scanning direction and the ink ejected from the plural ink ejecting openings is directed downward. As an energy generating unit for ejecting the ink droplets, for example, a device such as a piezoelectric device, a thermal actuator utilizing the phase change due to the film boiling phenomenon of fluid using an electrothermal conversion device such as a heat-generating resistor member, a shape-memory-alloy actuator utilizing the metallic phase change due to temperature change, and an electrostatic actuator utilizing electrostatic power may be used. In this embodiment, for example, the piezoelectric actuator is used in the recording head 14.

In addition, in the carriage 13, there are sub tanks 15 that are fluid containers for supplying each ink to the corresponding recording head 14. Each ink is supplied from the corresponding ink cartridge 9 to the corresponding sub tank 15 via the corresponding ink supply tube 16. The ink cartridges 9 store the corresponding inks of yellow (Y), cyan (C), magenta (M), and black (B) as the color components of the inkjet recording device. The sub tanks 15 supply the ink to the recording heads 14 and the ink cartridges 9 supply the ink to the sub tanks 15. The sub tanks 15 and the ink cartridges 9 constitute an ink supplying device.

In the inkjet recording device, there is a paper feeding section for feeding the recording papers 18 accumulated on the paper accumulating section (thick plate) 17 of the paper feeding tray 2. The paper feeding section includes a half-moon roller (paper feeding roller) 19 and a separation pad 20. The half-moon roller (paper feeding roller) 19 separates and feeds one sheet of recording papers 18 at a time from the paper accumulating section 17. The separation pad 20 faces the paper feeding roller 19. The separation pad 20 is pressed toward the side of the paper feeding roller 19.

Further, in the inkjet recording device, there is a feeding section for feeding the recording papers 18 from the paper feeding tray 2 to a position below the recording heads 14 through a guide 21. The feeding section includes a conveying belt 22, a counter roller 23, a conveying guide 24, a pressing member 25, a head pressure roller 26, a charge roller 27, a conveying roller 28, a tension roller 29, and a guide member 30. The conveying belt 22 electrostatically attracts and conveys the recording paper 18. The counter roller 23 sandwiches the recording paper 18 from the paper feeding section through the guide 21 with the conveying belt 22 to convey the sandwiched recording paper 18. The conveying guide 24 changes the feeding direction of the recording paper 18 fed substantially vertically upward by substantially 90 degrees so that the recording paper 18 is placed on the conveying belt 22. The head pressure roller 26 is pressed toward the conveying belt 22 by the pressing member 25. The charge roller 27 is a charging unit for charging the surface of the conveying belt 22. Herein, the conveying belt 22 is an endless belt suspended between the conveying roller 28 and the tension roller 29 so as to rotate in the belt conveying direction as shown in FIG. 3. The charge roller 27 contacts the surface of the conveying belt 22 and is disposed so that the charge roller 27 rotates according to the rotation of the conveying belt 22.

At the rear side of the conveying belt 22, there is the guide member 30 disposed corresponding to the printing area defined by the recording heads 14. The upper surface of the guide member 30 protrudes to the side of the recording heads 14 beyond the upper tangent line between the conveying roller 28 and the tension roller 29 each roller supporting the conveying belt 22. Because of this structure, the conveying belt 22 is pressed upward and guided by the upper surface of the guide member 30, thereby maintaining the high-precision flatness of the conveying belt 22.

Further, in the inkjet recording device, there is a discharging section for discharging the recording paper 18 recorded on by the recording heads 14. The discharging section includes a separating click 31 and paper discharging rollers 32 and 33. The separating click 31 separates the recording paper 18 from the conveying belt 22. The paper discharging tray 3 is disposed below the paper discharging roller 32. The position between the paper discharging rollers 32 and 33 is set higher to some extent than the paper discharging tray 3 so that as many recording papers 18 as possible can be stored in the paper discharging tray 3.

Further, a double-sided paper feeding unit 34 is removably attached to the rear side of the device main body 1. The double-sided paper feeding unit 24 receives the recording paper 18 returned by the reverse rotation of the conveying belt 22, turns the recording paper 18 over, and feeds the recording paper 18 to a position between the counter roller 28 and the conveying belt 22 again. On the double-sided paper feeding unit 34, there is a manual paper feeding unit 35.

Further, as shown in FIG. 3, there is a maintaining and restoring mechanical section 36 disposed in a non-printing area on one side in the scanning direction of the carriage 13. The maintaining and restoring mechanical section 36 is a reliability maintaining unit for maintaining and restoring the condition of the nozzles of the recording heads 14. Further, there is an ink collecting container 37 disposed in another non-printing area on the other side in the scanning direction of the carriage 13.

Figure 4:
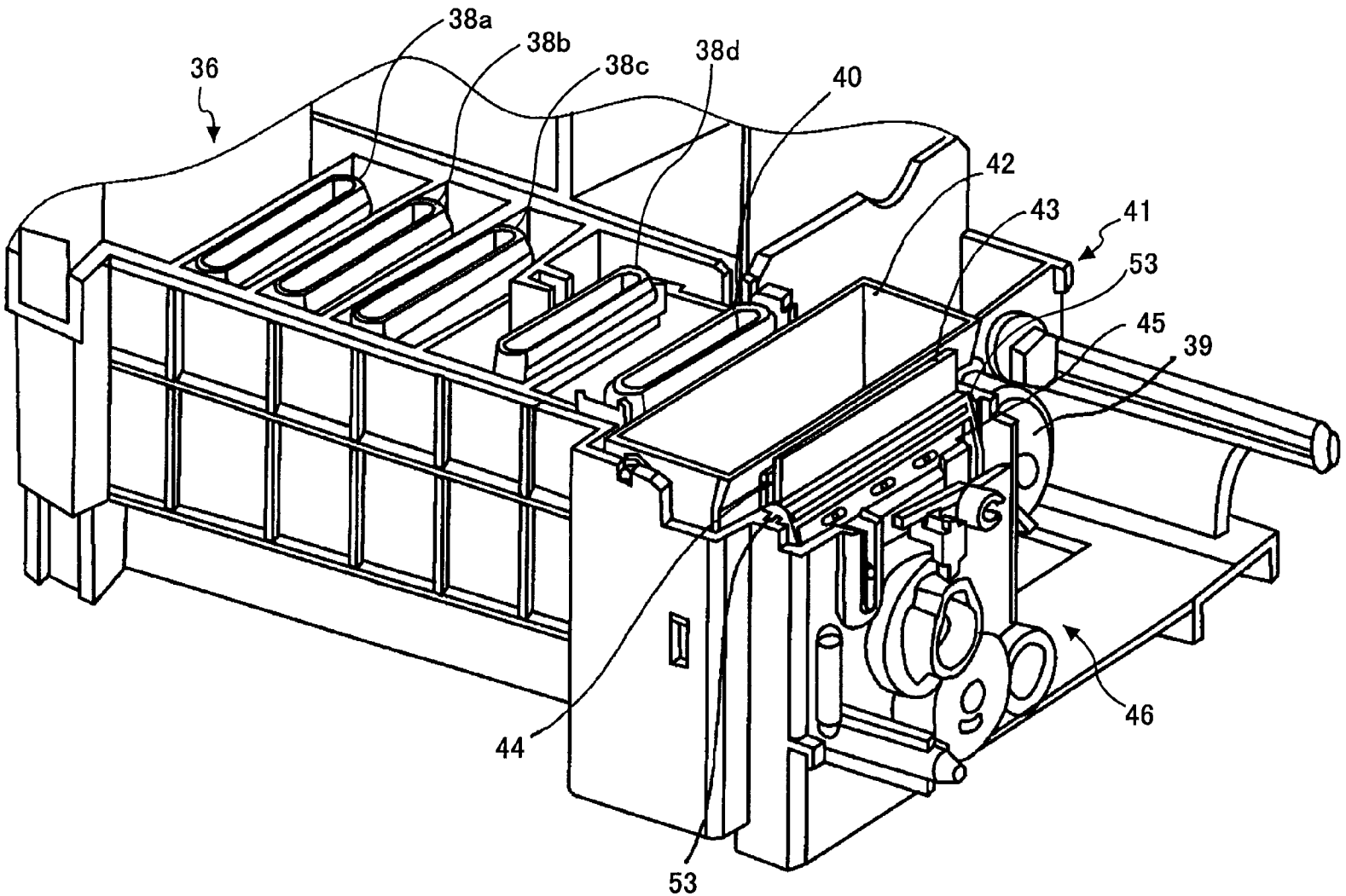
FIG. 4 is a cut-open perspective view showing a maintaining and restoring mechanical part of the inkjet recording device.

As shown in FIG. 4, the maintaining and restoring mechanical section 36 includes capping members 38*a* through 38*d*, a suction pump 39, a suction cap 40 in communication with the suction pump 39, a wiping unit 41 for cleaning the nozzle surface by wiping, and an ink collecting section 42. The capping members 38*a* through 38*d* cap the nozzle surface to prevent the nozzles of the recording heads 14 from drying. The suction pump 39 is provided for filling the recording heads 14 with ink.

Figure 5:
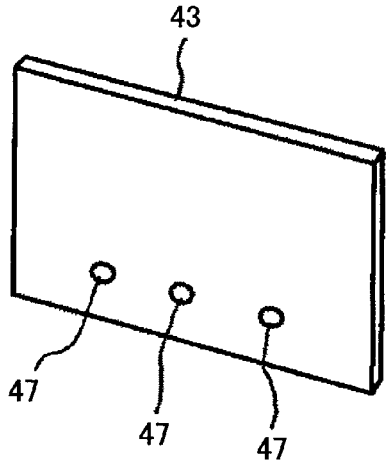
FIG. 5 is a drawing showing a wiper blade used in the inkjet recording device.
Figure 6A:
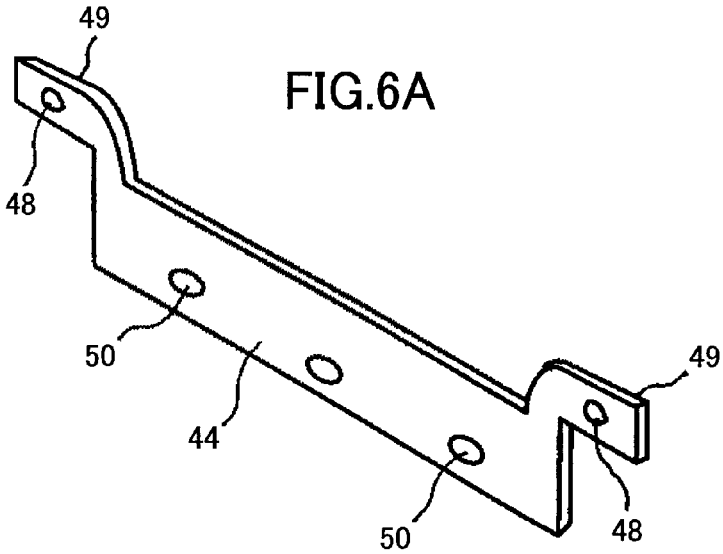
FIGS. 6A and 6B are drawings showing the configuration of a reaction force eliminating member used in the inkjet recording device.
Figure 6B:
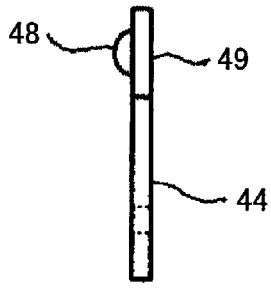

The wiping unit 41 includes a wiper blade 43, a reaction force eliminating member 44, a supporting member 45, and a blade elevating mechanical section 46. The wiper blade 43 is made of an elastic material such a rubber elastic material and formed in a tabular shape as shown in FIG. 5. The wiper blade 43 includes plural, for example three, attaching holes 47 on the middle lower side of the wiper blade 43. The wiper blade 43 wipes off the ink droplets and foreign matter attached to the nozzle surface while pressing the header section of the wiper blade 43 toward the nozzle surface. The reaction force eliminating member 44 has a spring characteristic and is made of a material having a Young's modulus higher than the wiper blade 43 has such as Ethylene Propylene Methylene Linkage (EPML) and silicon as an elastic material, stainless and aluminum as the metallic material of a non-elastic material, and ABS and polyoxymethylene (POM) as a resin material and formed in a tabular shape as shown in FIGS. 6A and 6B. The reaction force eliminating member 44 includes a blade contacting section 49 and attaching holes 50. The blade contacting section 49 has two convex parts 48 provided one on each upper side so that the convex parts 48 contact the wiper blade 43. The attaching holes 50 are formed in the middle part of the reaction force eliminating member 44.

Figure 7B:
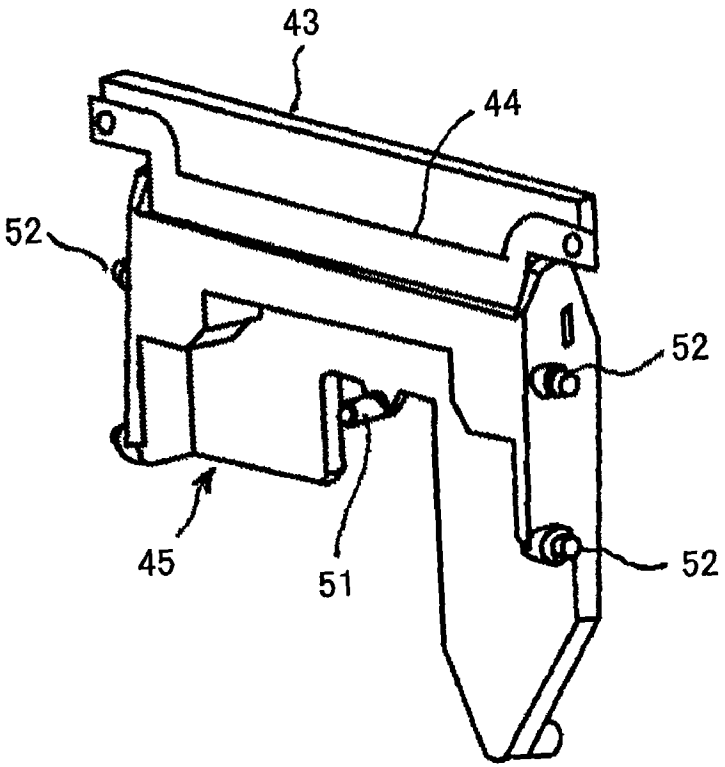
FIGS. 7A and 7B are drawings showing the configuration of a supporting member used in the inkjet recording device.
Figure 7A:
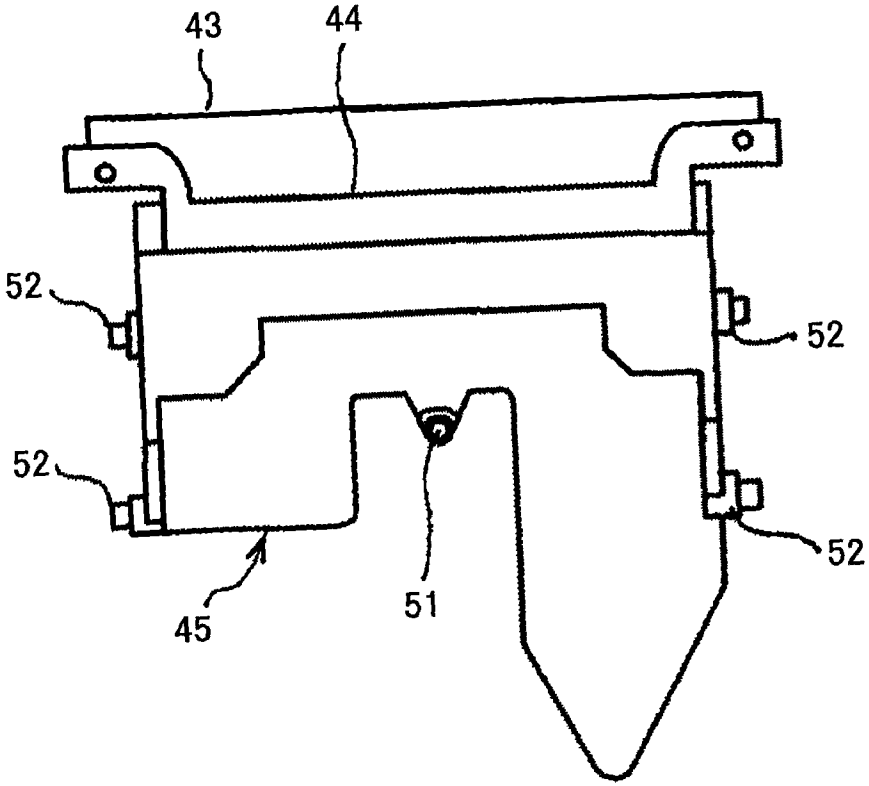
Figure 8:
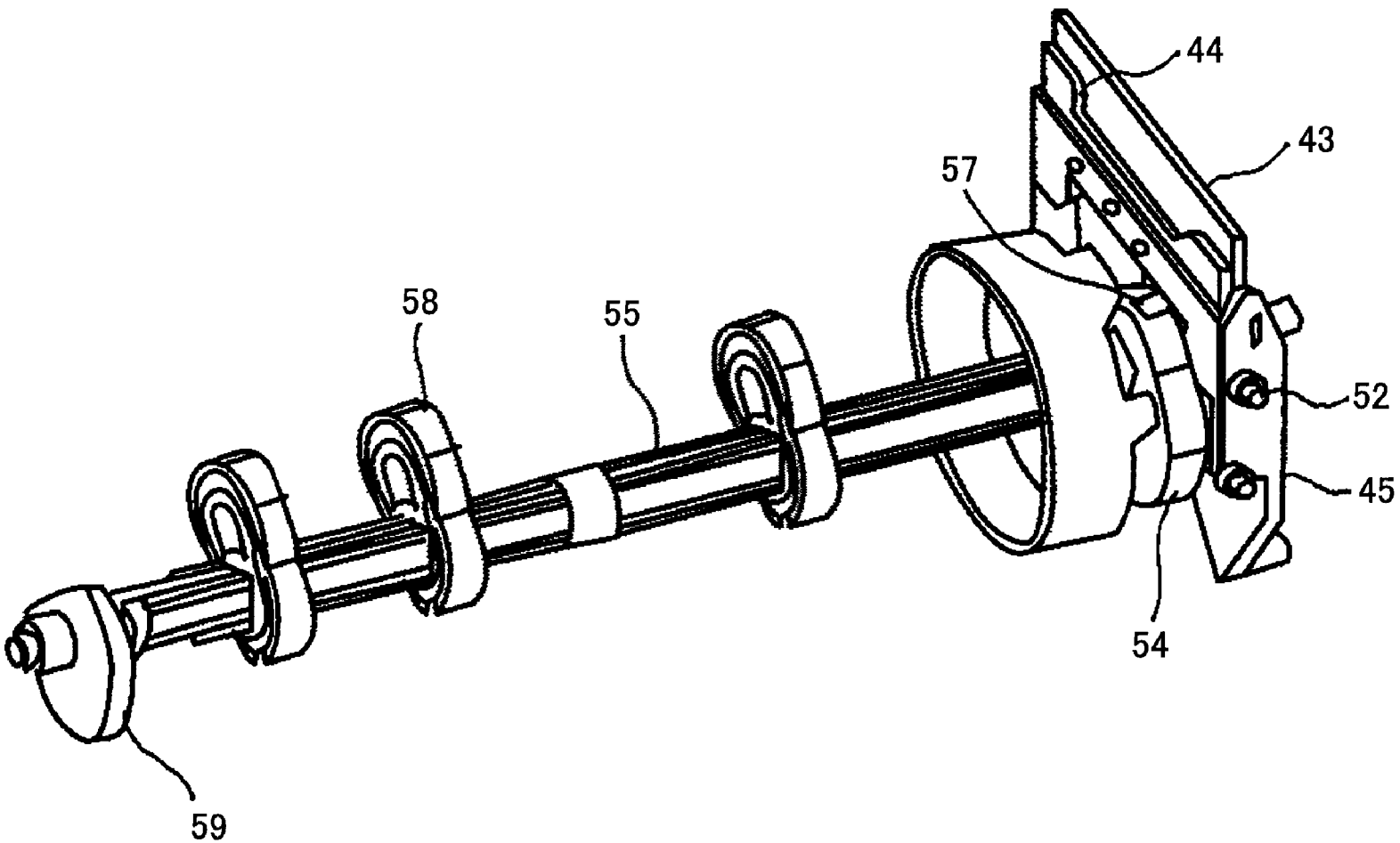
FIG. 8 is a drawing showing the configuration of a blade elevating mechanical part used in the inkjet recording device.
Figure 9B:
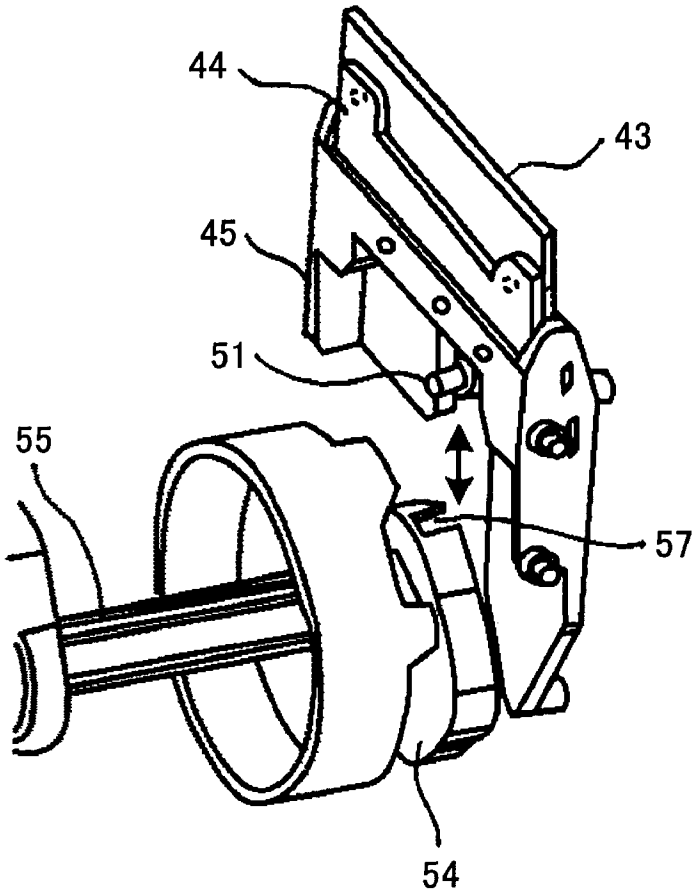
FIGS. 9A and 9B are drawings showing where the supporting member is engaged with the blade elevating member.
Figure 9A:
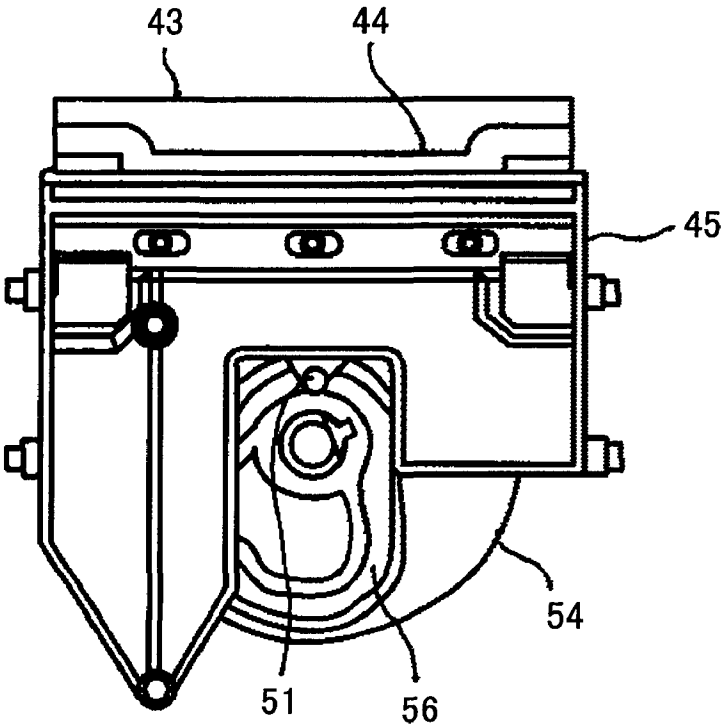

As shown in FIGS. 7A and 7B, the wiper blade 43 and the reaction force eliminating member 44 are attached to the supporting member 45 such that the convex parts 48 formed on the blade contacting section 49 of the reaction force eliminating member 44 face and contact the wiper blade 43. The supporting member 45 has a boss 51 at the middle lower part for elevating the supporting member 45 and a pair of guide rollers 52 provided on each end side in the width direction. The blade elevating mechanical section 46 is provided between the both ends in the width direction as shown in FIG. 4 and includes guide grooves 53 for guiding the guide rollers 52 of the supporting member 45 and an axle cam 55 having a plate cam 54 at one end of the axle cam 55 as shown in FIG. 8. The plate cam 54, as shown in FIGS. 9A and 9B, has a cam groove 56 on the surface of the plate cam 54 for engaging the boss 51 for elevating the supporting member 45 and a cut-out section 57 disposed substantially where the cam groove 56 is closest to the rotating center of the cam groove 56 so that the boss 51 is inserted through the cut-out section 57. The axle cam 55 is supported by plural guide sections 58 and has a rotation transmission section 59 connected to a rotation driving section (not shown) through the other end of the rotation transmission section 59.

To configure the wiping unit 40, first, the axle cam 55 of the blade elevating mechanical section 46 is positioned so that the cut-out section 57 of the plate cam 54 is positioned at the top of the plate cam 54. Next, the guide rollers 53 of the supporting member 45 with the wiper blade 43 and the reaction force eliminating member 44 attached to the supporting member 45 are inserted into the guide grooves 53. Then, the boss 51 for elevating the supporting member 54 is inserted into the cut-out section 54 so that the boss 51 is engaged into the cam groove 56. In this manner, the supporting member 45 is attached to the blade elevating mechanical section 46 to configure the wiping unit 40. According to this mechanism where the supporting member 45 with the wiper blade 43 and the reaction force eliminating member 44 fixed to the supporting member 45 is attached to the blade elevating mechanical section 46, the wiper blade 43 and the reaction force eliminating member 44 are raised and lowered according to the movement of the supporting member 45 up and down by rotating the axle cam 55 so as to move the boss 51 upward and downward along the cam groove 56 of the plate cam 54.

The operation of wiping off the ink droplets and foreign matter attached to the nozzle surface of the recording heads 14 using the wiper blade 43 being moved upward and downward by the blade elevating mechanical section 46 is described with reference to FIGS. 10A through 10C.

Figures 10A, 10B, 10C:
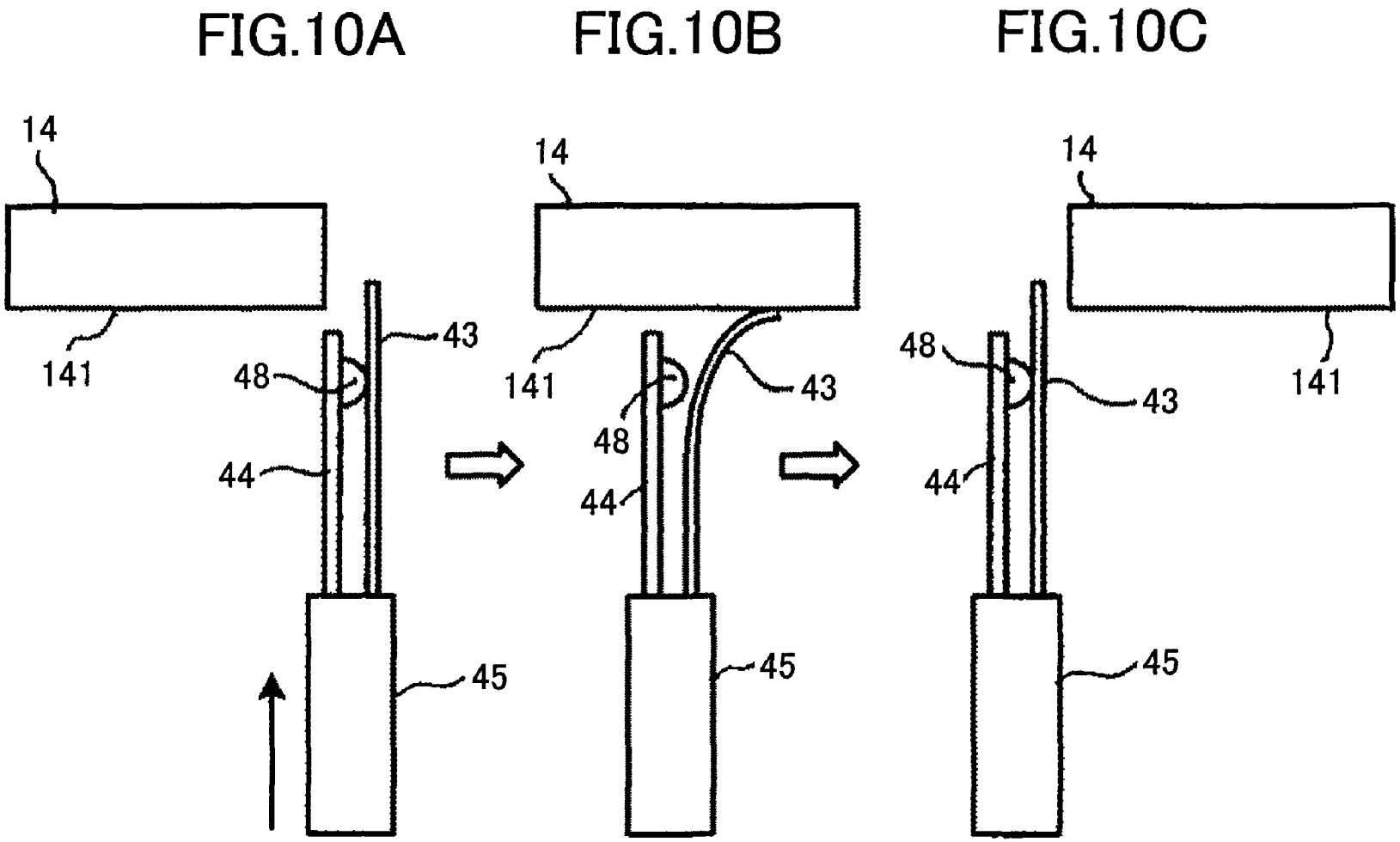
FIGS. 10A through 10C are drawings showing the wiping operation of the wiper blade.

When the recording heads 14 moving at a constant speed of the carriage 13 approach the maintaining and restoring mechanical section 36, the supporting member 45 with the wiper blade 43 and the reaction force eliminating member 44 fixed to the supporting member 45 is raised by rotating the axle cam 55 of the blade elevating mechanical section 46 to the position where the reaction force eliminating member 44 does not contact the nozzle surface but the header portion of the wiper blade 43 protrudes by a prescribed length beyond the nozzle surface 141 of the recording heads 14 as shown in FIG. 10A. In this condition, when the moving recording heads 14 contact the wiper blade 43, as shown in FIG. 10B, the wiper blade 43 bends and the header portion of the wiper blade 43 is in contact with and pressed toward the nozzle surface 141. As a result, as the recording heads 14 move, the ink droplets and foreign matter attached to the nozzle surface 141 are wiped off and removed. Then, the recording heads 14 further move. When the end of the nozzle surface 141 passes over the header portion of the bent wiper blade 43 and the header portion of the wiper blade 43 separates from the nozzle surface 141 and while the bend of the wiper blade 43 is returned to its idle position, both end portions of the wiper blade 43 contact the corresponding convex parts 48 of the blade contacting sections 49 of the reaction force eliminating member 44 and the reaction force generated when the bent of the wiper blade 43 is straightened is absorbed by the spring characteristic of the reaction force eliminating member 44 so as to return the wiper blade 43 to its idle position. Because of this feature, the reaction force generated when the bend of the wiper blade 43 is suddenly straightened can be controlled, thereby preventing the ink droplets and foreign matter attached to the header portion of the wiper blade 43 from being scattered and avoiding the contamination in the device main body 1 of the inkjet recording device and the degradation of the quality of the forming images.

When the recording heads 14 passed beyond the maintaining and restoring mechanical section 36, the supporting member 45 with the wiper blade 43 and reaction force eliminating member 44 fixed to the supporting member 45 is lifted down to a prescribed position by rotating the axle cam 55 of the blade elevating mechanical section 46.

To remove and replace the wiper blade 43 of the maintaining and restoring mechanical section 36, the axle cam 55 of the blade elevating mechanical section 46 is rotated so that the cut-out section 57 of the plate cam 54 is positioned at the boss 51 for elevating the supporting member 45 and the supporting member 45 is pulled out of the blade elevating mechanical section 46. Then the wiper blade 43 and the reaction force eliminating member 44 are removed from the supporting member 45 and replaced by a new wiper blade 43 and a new reaction force eliminating member 44. In this manner, wiper blade 43 can be replaced easily and the maintenance operation can be performed easily.

The present invention is not limited to the above-mentioned embodiments, and variations and modifications may be made without departing from the scope of the present invention.

The present application is based on and claims the benefit of priority of Japanese Patent Application No. 2007-059388, filed on Mar. 9, 2007 the entire contents of which are hereby incorporated by reference.

What is claimed is:

1. An inkjet recording device comprising:

a recording head ejecting ink droplets to record a character and an image onto a recording medium;

a carriage with the recording head mounted thereon performing a round-trip scanning movement;

a wiping unit including:

a wiper blade made of an elastic body and formed in a tabular shape for wiping a nozzle surface of the recording head, the wiper blade including end portions disposed at respective ends in a longitudinal direction of the wiper blade, and a header portion configured to include a side edge extending in the longitudinal direction of the wiper blade and to contact and wipe the nozzle surface of the recording head;

a reaction force eliminating member having a flat plate shape, wherein the reaction force eliminating member and the wiper blade are disposed to be parallel to, and facing, each other, the reaction force eliminating member includes a base portion having upper end parts disposed to correspond to the respective end portions of the wiper blade, and the reaction force eliminating member further includes blade contacting sections protruding from the respective upper end parts of the base portion and having respective convex parts disposed on the blade contacting sections, the convex parts being disposed beyond the base portion in the longitudinal direction of the wiper blade and in a direction perpendicular to the longitudinal direction of the wiper blade in a plane of the reaction force eliminating member, and to protrude from the plane of the respective blade contacting sections to contact the respective end portions of the wiper blade, and the reaction force eliminating member has spring characteristics to absorb a reaction force of the wiper blade generated when the header portion of the wiper blade separates from the nozzle surface of the recording head and a bend of the wiper blade is straightened at a termination of a wiping operation through the end portions contacting the corresponding convex parts of the blade contacting sections of the reaction force eliminating member to return the wiper blade to an upright position; and a supporting member supporting the wiper blade and the reaction force eliminating member; and a blade elevating unit disposed within a scanning range of the carriage and moving the wiping unit upward and downward in the height direction of the nozzle surface of the recording head.

2. The inkjet recording device according to claim 1, wherein the reaction force eliminating member is made of a material having a Young's modulus higher than that of the wiper blade.

3. The inkjet recording device according to claim 1, wherein the supporting member is removably attached to the blade elevating unit.

4. The inkjet recording device according to claim 1, wherein the reaction force eliminating member is made of an elastic material having a spring characteristic.

5. The inkjet recording device according to claim 1, wherein the reaction force eliminating member is made of a metallic material having a spring characteristic.

6. The inkjet recording device according to claim 1, wherein the reaction force eliminating member is made of a resin material having a spring characteristic.

7. The inkjet recording device according to claim 1, wherein each of the convex parts has a substantially point contact relationship with the wiping blade at the upright position.

8. The inkjet recording device according to claim 1, wherein each of the convex parts has a hemispherical shape.

9. The inkjet recording device according to claim 1, wherein the convex parts of the reaction force eliminating member first contact the wiping blade after the wiper blade separates from the nozzle surface of the recording head and the bend of the wiper blade is straightened to absorb the reaction force with a spring characteristic of the reaction force eliminating member while the wiper blade is returned to the upright position.

10. The inkjet recording device according to claim 1, wherein the reaction force eliminating member has a spring characteristic and reduces the reaction force generated when the wiper blade separates from the nozzle surface of the recording head by absorbing the reaction force with the spring characteristic of the reaction force eliminating member while the wiper blade is returned to the upright position.

11. The inkjet recording device according to claim 1, wherein when the wiper blade and the reaction force eliminating member are attached uprightly to the supporting member, a height of the reaction force eliminating member is greater than a half of a height of the wiper blade and is lower than the height of the wiper blade.

12. The inkjet recording device according to claim 11, wherein the wiper blade is in contact with the reaction force eliminating member face at a position higher than the half of the height of the wiper blade.

13. The inkjet recording device according to claim 1, wherein the blade elevating unit moves the supporting member and wiper blade attached uprightly to the supporting member upward and downward in the height direction of the nozzle surface of the recording head.

14. The inkjet recording device according to claim 1, wherein the wiper blade bends away from and loses contact with the convex parts of the reaction force eliminating member.

* * * * *